United States Patent [19]

Buckley

[11] Patent Number: 4,919,293

[45] Date of Patent: Apr. 24, 1990

[54] MULTI-UNIT DISPENSING CONTAINER ASSEMBLY

[76] Inventor: Paul Buckley, 78 Orchard St., Cranston, R.I. 02910

[21] Appl. No.: 360,427

[22] Filed: Jun. 2, 1989

[51] Int. Cl.[5] ..... B65D 37/00; B65D 85/67

[52] U.S. Cl. ..... 220/23.2

[58] Field of Search ..... 220/23.2

[56] References Cited

U.S. PATENT DOCUMENTS

| | | | |
|---|---|---|---|
| 420,335 | 1/1890 | Graig | 220/23.2 |
| 915,452 | 3/1909 | Litts | 220/23.2 |
| 1,517,388 | 12/1924 | Arslanian | 220/23.2 |
| 1,568,160 | 1/1926 | Hibbert | 220/23.2 |
| 2,030,899 | 2/1936 | Scurlock | 211/77 |
| 2,620,790 | 12/1952 | Richardson | 220/23.2 |
| 2,707,379 | 5/1955 | Guior | 220/23.2 |
| 2,726,004 | 12/1955 | McLeod | 220/23.2 |
| 2,764,309 | 9/1956 | Zelonka | 220/23.4 |
| 2,883,082 | 4/1959 | Schlumbohm | 220/23.2 |
| 3,051,502 | 8/1962 | Webster | 220/23.2 |
| 3,245,565 | 4/1966 | Zeppenfeld et al. | 220/23.2 |
| 3,269,389 | 8/1966 | Meurer et al. | 128/198 |
| 3,642,163 | 2/1972 | McFarland | 220/23.2 |
| 4,098,397 | 7/1978 | Mann, Jr. et al. | 206/217 |
| 4,126,239 | 11/1978 | Gehrig et al. | 215/6 |
| 4,165,812 | 8/1979 | Jennison | 215/10 |
| 4,189,057 | 2/1980 | Morille | 220/23 |
| 4,196,808 | 4/1980 | Pardo | 220/23.2 |
| 4,320,846 | 3/1982 | Meyering et al. | 220/20 |
| 4,708,253 | 11/1987 | Mednis | 215/10 |
| 4,785,931 | 11/1988 | Weir et al. | 206/222 |

FOREIGN PATENT DOCUMENTS

| | | | |
|---|---|---|---|
| 527391 | 7/1956 | Canada | 220/23.2 |
| 659409 | 4/1938 | Fed. Rep. of Germany | 220/23.2 |
| 2727461 | 4/1979 | Fed. Rep. of Germany | 220/23.2 |

*Primary Examiner*—Stephen Marcus
*Assistant Examiner*—Stephen Castellano
*Attorney, Agent, or Firm*—W. Thad Adams, III

[57] ABSTRACT

A multi-unit dispensing container assembly, comprising a plurality of separate, elongate tubular dispensing containers which mate together in surface-to-surface contact along adjacent side walls. Hinges connect the containers along side edges of the adjacent side walls to permit movement of the containers. The containers can move back and forth between a closed position in which the adjacent walls mate together in surface-to-surface contact and a plurality of open positions in which the adjacent walls are variably spaced from each other except at their respective side edges.

10 Claims, 2 Drawing Sheets

MULTI-UNIT DISPENSING CONTAINER ASSEMBLY7

TECHNICAL FIELD AND BACKGROUND OF THE INVENTION

This invention relates to a multi-unit dispensing container assembly, which according to the preferred embodiment disclosed in this application, can comprise a plurality of connected-together containers for holding dispensable products such as shampoo, conditioner, lotions, beverages, powders or the like in a compact sized-package suitable for travel. The assembly can be closed and secured in that position to form a small, self-supporting package which will easily fit within a suitcase or makeup case. When opened, the assembly allows easy access to each of the containers forming the assembly and can be suspended by a cord from a shower head or similar structure.

SUMMARY OF THE INVENTION

Therefore, it is an object of the invention to provide a multi-unit container assembly particularly adapted for compactness.

It is another object of the invention to provide a multi-unit container assembly which is moveable between an open and closed position while remaining together as a unit.

It is another object of the invention to provide a multi-unit container assembly which is shaped to form a closed assembly with mating adjacent walls.

These and other objects of the present invention are achieved in the preferred embodiments disclosed below by providing a multi-unit dispensing container assembly, comprising a plurality of separate, elongate tubular dispensing containers which mate together in surface-to-surface contact along adjacent side walls, and hinge means connecting the containers along side edges of the adjacent side walls to permit movement of the containers. The containers can move back and forth between a closed position in which the adjacent walls mate together in surface-to-surface contact and a plurality of open positions in which the adjacent walls are variably spaced from each other except at their respective side edges.

According to one preferred embodiment of the invention, the separate containers are identical to each other.

According to another preferred embodiment of the invention, the containers are each polygonal in cross-section.

According to yet another preferred embodiment of the invention, the containers have at least three sides which include two adjacent flat sides and a curved side.

Preferably, the polygonal shape is pentagonal and the assembly includes closure means for holding the assembly in the closed position.

According to one preferred embodiment of the invention, the closure means comprises a small patch of female loop material secured to a first of the containers and a small, complementary patch of male hook material secured to the one of the containers adjacent to the first container for releasable attachment with the female loop material.

Preferably, the assembly, when in the closed position, defines a hexagon in cross-section.

According to another preferred embodiment of the invention, the assembly, when in the closed position, defines a circle in cross-section and is shaped substantially as a cylinder.

According to yet another preferred embodiment of the invention, the assembly includes a cord secured to the assembly by which the assembly can be suspended.

BRIEF DESCRIPTION OF THE DRAWINGS

Some of the objects of the invention have been set forth above. Other objects and advantages of the invention will appear as the invention proceeds when taken in conjunction with the following drawings, in which.

DESCRIPTION OF THE PREFERRED EMBODIMENT AND BEST MODE

Figure 1:
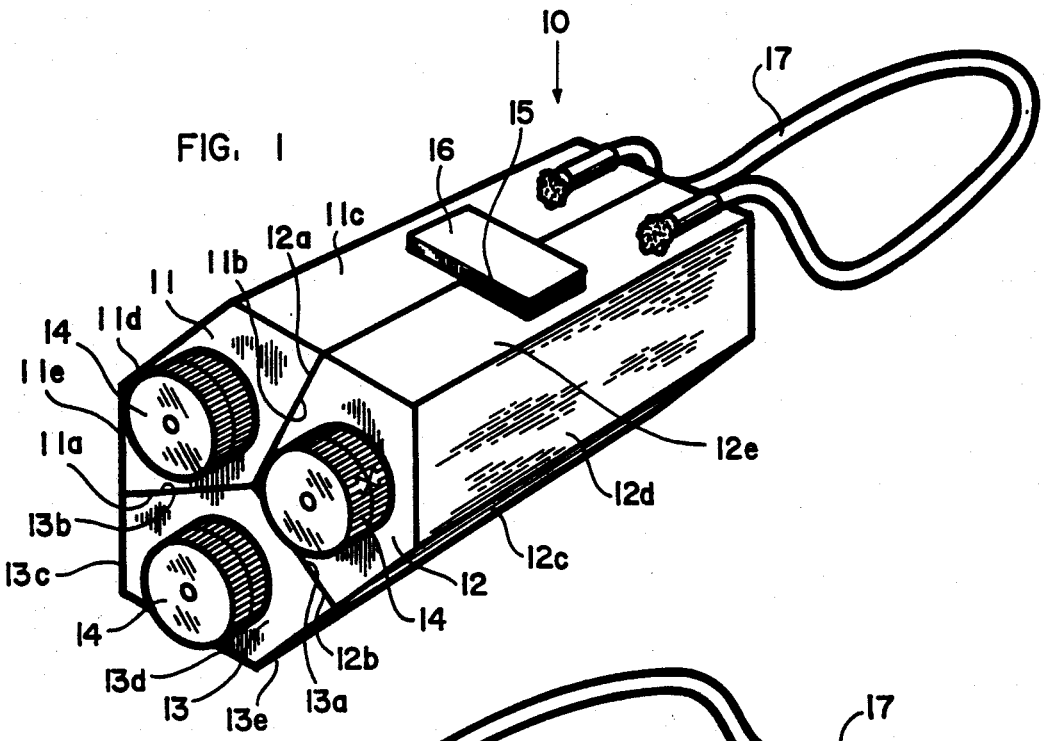
FIG. 1 is a perspective view of an assembly according to one embodiment of the invention in the closed position.

Referring now specifically to the drawings, a multi-unit dispensing container assembly according to one embodiment of the present invention is illustrated in FIG. 1 and shown generally at reference numeral 10. The assembly 10 is formed of three identical tubular containers 11, 12 and 13, preferably of molded plastic. Depending upon the intended use, the containers 11, 12 and 13 may be either relative rigid or squeezable. A dispensing cap 14 on one end of each of the containers 11, 12, 13 permits the contents of the containers to be dispensed and when any individual container is empty, removed for refilling. Of course, many different types of closures can be used. The cap 14 shown in FIG. 1 can be opened by twisting the outer ring in one direction and closed by twisting the outer ring in the other direction. The cap 14 is removed for refilling by unscrewing the inner ring. Each of the containers 11, 12 and 13 have a pentagonal shape in cross-section. Containers 11, 12 and 13 have two interior side walls 11*a*, 11*b*; 12*a*, 12*b*; and 13*a* and 13*b*, respectively, which mate together in surface-to-surface contact as is shown in FIG. 1. The exterior side walls 11*c*, 11*d*, 11*e*; 12*c*, 12*d*, 12*e* and 13*c*, 13*d* and 13*e* form a compact shape which, in combination with the interior side walls provide mutual support which creates a strong unitary structure.

Containers 11, 12 and 13 are secured together by hinges in the form of thin strips 20, 21 of plastic of a type resistant to breakage due to repeated flexure. Hinge strips 20, 21 are secured by heat sealing or by an adhesive to adjacent side walls of containers 11 and 13 (hinge strip 20) and containers 12 and 13 (hinge strip 21). Alternatively, containers 11, 12, 13 can be molded as a single structure with integral hinges molded between the adjacent containers.

A male and female Velcro fastener assembly 15 and 16 permit assembly 10 to be secured in the closed position. A cord 17 is secured by opposite ends to the end of containers 11 and 12 opposite from the end on which caps 14 are located and permit assembly 10 to be suspended from a shower head or other structure so that contents will be dispensed under the influence of gravity when cap 14 is opened.

Figure 2:
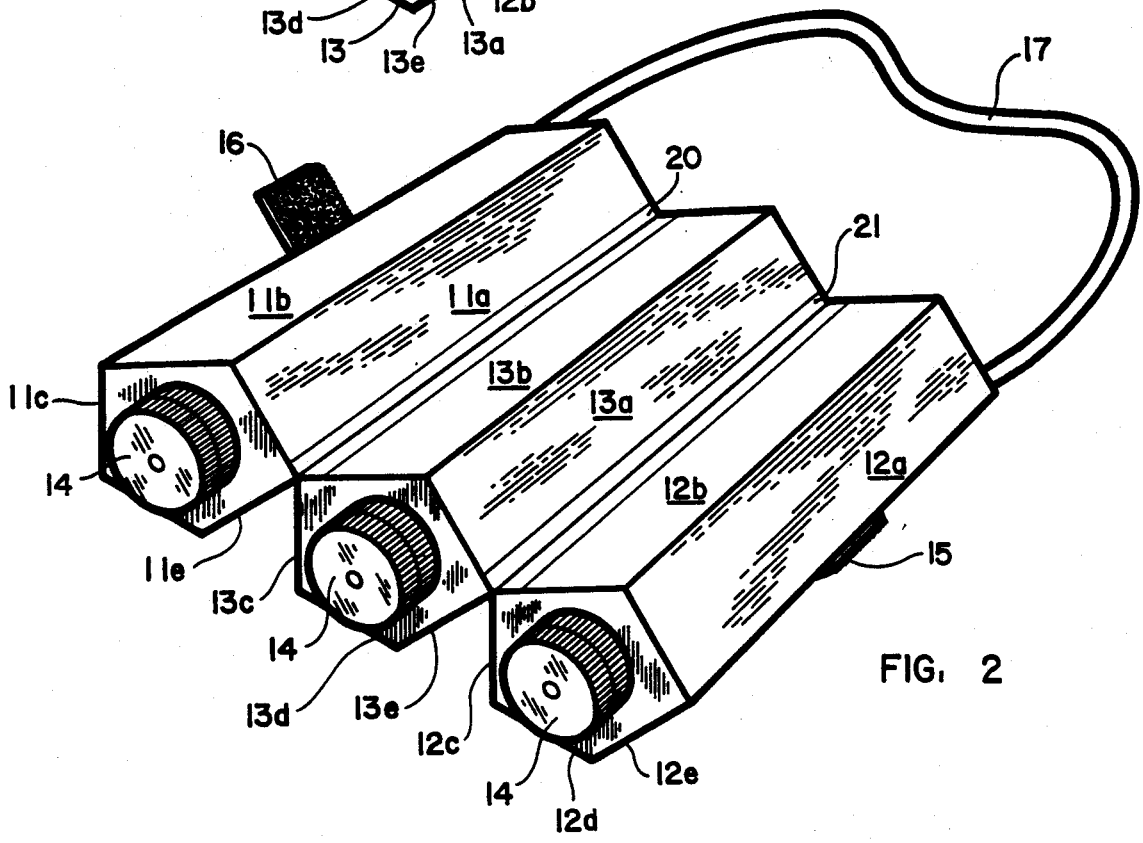
FIG. 2 is a perspective view of the assembly in FIG. 1 in a fully open position.

In its opened position, as is shown in FIG. 2, the assembly forms a row of dispensing containers 11, 12, 13.

Figure 3:
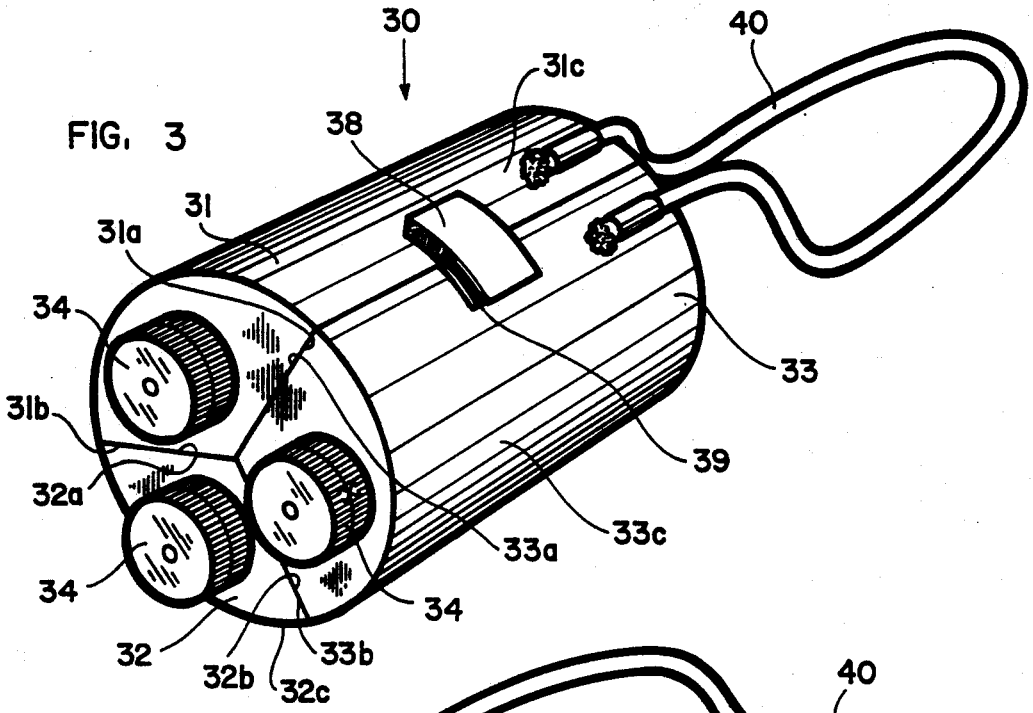
FIG. 3 is a perspective view of an assembly according to another embodiment of the invention.
Figure 4:
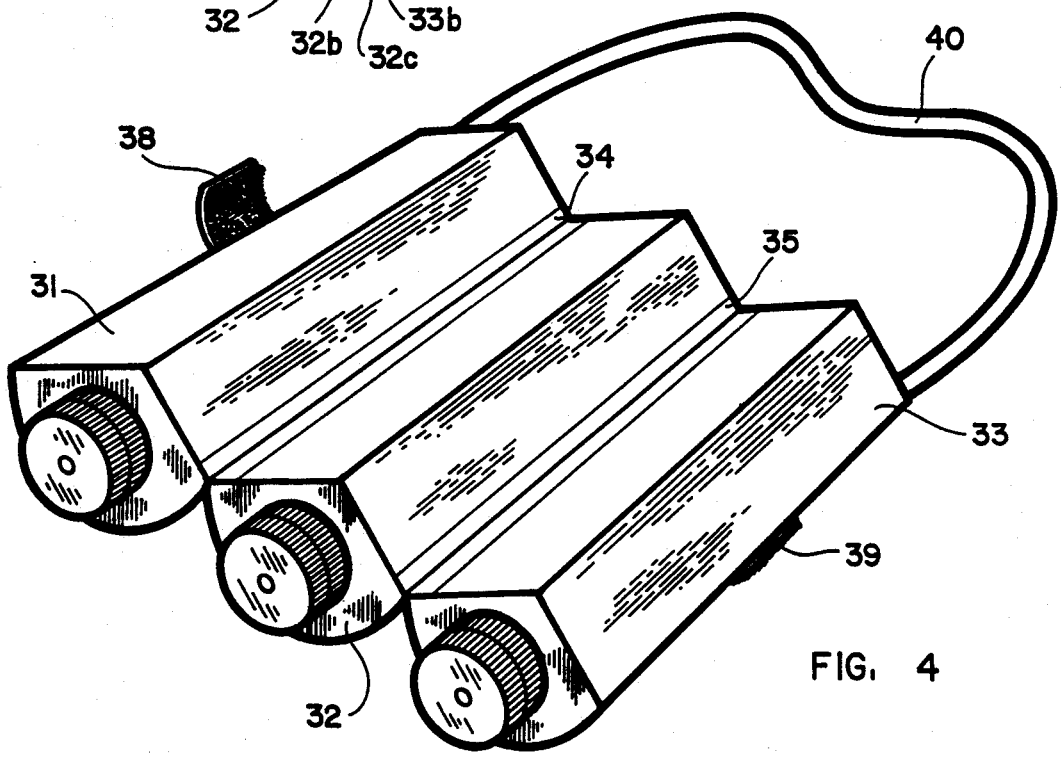
FIG. 4 is a perspective view of the assembly in FIG. 3 in a fully open position.

Referring to FIG. 3, another assembly 30 according to another embodiment of the invention is shown. Assembly 30 is formed of three identical tubular containers 31, 32 and 33, preferably of molded plastic. Depending upon the intended use, the containers 31, 32 and 33 may be either relative rigid or squeezable. A dispensing cap 34 on one end of each of the containers 31, 32, 33 permits the contents of the containers to be dispensed and when any individual container is empty, removed for refilling. Dispensing caps 34 are identical in structure to that described above with relation to assembly 10. Each of the containers 31, 32 and 33 have a "pie" shape in cross-section, i.e., two adjacent diverging straight sides joined by an arcuate outer side. Specifically, containers 31, 32 or 33 have two interior side walls 31*a*, 31*b*, 32*a*, 32*b* and 33*a* and 33*b*, respectively, which mate together in surface-to-surface contact. The exterior side walls 31*c*, 32*c* and 33*c* define respective 120 arcs which, when the assembly is closed, form a compact cylindrical shape which, in combination with the interior side walls provide mutual support which creates a strong unitary structure. Containers 31, 32 and 33 are secured together by a thin hinge strips 34, 35 of plastic of a type resistant to breakage due to repeated flexure. Hinge strips 34, 35 are secured by heat sealing or by an adhesive to adjacent sides of containers 31 and 32 (hinge strip 34) and containers 32 and 33 (hinge strip 35). Alternatively, containers 31, 32 and 33 can be molded as a single structure with integral hinges between the adjacent containers.

A male and female Velcro fastener assembly 38, 39 permit assembly 30 to be secured in the closed position. A cord 40 is secured by opposite ends to the end of containers 31 and 33 opposite from the end on which caps 34 are located and permit assembly 30 to be suspended from a shower head or other structure.

In its open position, as is shown in FIG. 2, the assembly forms a row of dispensing containers 31, 32, 33.

Other shapes and designs are possible within the teaching of this invention. The number of containers in the assembly can be varied, subject to the requirement that adjacent walls fit together in surface-to-surface contact.

A multi-unit dispensing container assembly is described above. Various details of the invention may be changed without departing from its scope. Furthermore, the foregoing description of the preferred embodiment of the invention and the best mode for practicing the invention are provided for the purpose of illustration only and not for the purpose of limitation—the invention being defined by the claims.

I claim:

1. A multi-unit dispensing container assembly, comprising:

(a) a plurality of separate, elongate polygonal tubular dispensing containers which fit together in surface-to surface contact, each of said containers comprising a plurality of longitudinally-extending side walls, and first and second end walls on opposite ends of and integral with said side walls, and a closable opening positioned in one of said end walls, at least one of said side walls of each of said containers being adjacent to one of said side walls of another of said containers, and at least one of said side walls of each of said containers being non-adjacent to another of said side walls of another of said containers; and (b) hinge means connecting said containers along side edges of said adjacent side walls to permit movement of said containers between a closed position in which said adjacent side walls fit flush together, and said non-adjacent side walls abut to form a single planar surface; and an open position in which said adjacent side walls are spaced from each other except at said side edges of said adjacent side walls.

2. A container assembly according to claim 1, wherein the cross-sectional shape of each of said containers is an irregular polygon.

3. A container assembly according to claim 1, wherein each of said containers is pentagonal in cross-section.

4. A container assembly according to claim 1, wherein said separate containers are identical to each other.

5. A container assembly according to claim 1, wherein said containers are each polygonal in cross-section.

6. A container assembly according to claim 1, 2 or 3 and including closure means for holding said assembly in the closed position.

7. A container assembly according to claim 6, wherein said closure means comprises a small patch of female loop material secured to a first of said containers and a small, complementary patch of male hook material secured to one of said containers adjacent to said first container for releasable attachment with said female loop material.

8. A container assembly according to claim 5, wherein said assembly, when in the closed position, defines a hexagon in cross-section.

9. A container assembly according to claim 1, 2 or 3 and including a cord secured to said assembly by which the assembly can be suspended.

10. A container assembly according to claims 1, 2 or 3 wherein the number of containers in the assembly is at least three.

* * * * *